US005150776A

United States Patent [19]

Rebenack

[11] Patent Number: 5,150,776

[45] Date of Patent: Sep. 29, 1992

[54] TRAVEL CASE ORGANIZER

[76] Inventor: Frances S. Rebenack, 2095 Brookshire Rd., Akron, Ohio 44313

[21] Appl. No.: 644,382

[22] Filed: Jan. 23, 1991

[51] Int. Cl.[5] ..... A45C 13/02; A45C 13/30

[52] U.S. Cl. ..... 190/110; 190/36

[58] Field of Search ..... 190/109, 110, 13 R, 190/36, 13 C; 206/291, 292; 220/433, 549, 554

[56] References Cited

U.S. PATENT DOCUMENTS

| | | | |
|---|---|---|---|
| 341,604 | 5/1886 | Rice | 190/36 |
| 450,533 | 4/1891 | Schnadel | 190/36 |
| 556,526 | 3/1896 | Baker | 190/36 |
| 562,759 | 6/1896 | Cohen | 190/36 |
| 1,191,007 | 7/1916 | Kassel | 206/292 |
| 1,291,201 | 1/1919 | Shrum | 190/110 |
| 1,438,737 | 12/1922 | Witbeck | 190/36 |
| 1,617,365 | 2/1927 | Batts | 206/291 X |
| 1,742,656 | 1/1930 | Laprade | 190/110 X |
| 1,760,098 | 5/1930 | Wilt | 206/292 |
| 1,913,021 | 6/1933 | Butterick | 190/36 X |
| 1,978,873 | 10/1934 | Wheary | 206/292 X |
| 2,656,913 | 10/1953 | Kaplan | 206/290 X |
| 2,710,082 | 6/1955 | Ruge | 206/292 X |
| 2,765,106 | 10/1956 | Platt et al. | 190/119 X |
| 2,803,281 | 8/1957 | Sutton | 150/145 X |
| 2,935,181 | 5/1960 | Vineberg | 206/289 |
| 3,035,673 | 5/1962 | Schenkler | 206/291 X |
| 3,125,198 | 3/1964 | Stark | 190/110 |
| 3,137,374 | 6/1964 | Holtzman | 190/110 |
| 3,175,658 | 3/1965 | Bierman | 206/292 X |
| 3,263,779 | 9/1966 | Bialer | 190/110 |
| 3,734,249 | 5/1973 | Wilt | 190/109 X |
| 3,861,504 | 1/1975 | McGraw | 190/110 |
| 4,273,223 | 6/1981 | Tomlinson | 206/292 |
| 4,444,418 | 4/1984 | Goldstein | 190/16 X |
| 4,527,677 | 7/1985 | March et al. | 190/110 |
| 4,580,667 | 4/1986 | Herwood | 190/110 |
| 4,629,070 | 12/1986 | Roberg | 206/455 |

FOREIGN PATENT DOCUMENTS

| | | | |
|---|---|---|---|
| 3714887 | 12/1987 | Fed. Rep. of Germany | 190/13 R |
| 953148 | 11/1949 | France | 190/103 |
| 625061 | 9/1961 | Italy | 190/109 |
| 145977 | 7/1920 | United Kingdom | 190/109 |
| 413511 | 7/1934 | United Kingdom | 206/292 |
| 520467 | 4/1940 | United Kingdom | 206/292 |

*Primary Examiner*—Sue A. Weaver
*Attorney, Agent, or Firm*—Reese Taylor

[57] ABSTRACT

An organizer for a travel case includes at least one track attached to the interior of the case and one or more flexible divider sheets provided with lugs contoured for releasable engagement with the track. More than one track and a comparable number of lugs may be provided and the track may be releasably attached to the travel case.

5 Claims, 1 Drawing Sheet

TRAVEL CASE ORGANIZER

BACKGROUND OF THE INVENTION

This invention relates in general to luggage. The invention relates in particular to an organizer for a travel case which will permit the user to keep articles neat and enable removing articles without destroying the neatness of the case.

DESCRIPTION OF THE PRIOR ART

For travelers, it is, of course, well known to utilize a travel bag, such as a suitcase, a garment bag or the like, for carrying articles, such as clothing, while traveling. It is also well known in the prior art to provide inserts or the like for suitcases and garment bags which protect clothing or other articles carried within the travel bag even more effectively than does the case itself. As examples, Vineberg U.S. Pat. No. 2,935,181 discloses a flexible plastic sheet of material which may be used as a garment bag or an insert therefor, and McGraw U.S. Pat. No. 3,861,504 discloses a clear liner insert for a suitcase.

It is also known in the art to provide some sort of organizer in a travel case which will separate certain articles from other articles. There are several ways this is done. Probably the most popular way is through the use of trays. Many such trays are removable from the case to provide access to the rest of the case or bag. Shrum U.S. Pat. No. 1,291,201 and Wilt U.S. Pat. No. 1,760,098 are examples of this for traveling bags and suitcases, respectively. Further, trays may also be used to protect goods. Tomlinson U.S. Pat. No. 4,273,223 discloses a flexible, protective insert similar to the liner insert of McGraw above which is employed as a tray within the suitcase.

Other methods for separating articles in travel bags include pockets and divider assemblies. Bierman U.S. Pat. No. 3,175,658 provides an example of a pocket in a traveling bag which is utilized to store articles separately. March et al. U.S. Pat. No. 4,527,677 provides an example of a divider assembly for a carrying case.

The present invention uses dividers as its organizing component. Although March et al. does disclose dividers in general, the March assembly is removable only as a total unit and is made from an anti-static material to protect the articles stored within the case. Thus, the need exists for an organizer which separates and keeps neatly arranged clothing and other articles by employing dividers which may be removed one at a time from a traveling case.

It is known in the art to have a support member attached to a carrying case or traveling bag for receiving a hanger or the like, thus providing a certain order to the bag or case. Examples of such members include Batts U.S. Pat. No. 1,617,365 which discloses a support member having grooved support hooks which receive the suspension hooks of the hangers, and Kaplan U.S. Pat. No. 2,656,913 which discloses a garment holding case having a garment rack to receive the hangers on the inside of the case and a support member outside the case having arms which protrude through the case to receive and hold the garment racks. There are also support members which receive bars or shelves to provide organization to the case. For example, Ruge U.S. Pat. No. 2,710,082 discloses a valise having holding bars with eccentrics which engage the slots in the false ends to support the articles in the valise, and Stark U.S. Pat. No. 3,125,198 discloses a traveling case having support rails which receive vertically-spaced shelves which fit into notches and have spring-loaded bolts to fit into the openings. Wheary U.S. Pat. No. 1,978,873 and Kassel U.S. Pat. No. 1,191,007 are also representative of holding and separating devices which employ many of the structures just discussed.

While the prior art just discussed is presumably adequate for the purposes for which it was designed, none of it appears to provide for a device which will separate articles, such as clothing, by removing individual sections of the organizer or the entire organizer itself. Therefore, the need exists for an organizer having a member attached to the travel case as well as a way of removing individual sections independently attached to the member.

SUMMARY OF THE INVENTION

It is, therefore, an object of the present invention to provide a travel case which will separate articles and keep them neatly arranged therein.

It is also an object of this invention to provide an organizer for the travel case which may be entirely removed from the travel case or which may be removed in individual sections, permitting other sections to remain neatly arranged.

It has been found that these objects can be achieved by providing the organizer for a travel case with at least one dividing means for separating the articles within the travel case, the perimeter of each dividing means being configured to fit adequately within the travel case; lug means attached to each dividing means; and track means which removably attach to the travel case and releasably engage the lug means. It has been discovered that by lifting the dividing means out of the travel case, retrieving the article desired, and replacing the dividing means, the articles within the travel case will be kept neat.

Accordingly, production of an organizer of the type above-described becomes the principal object of the invention with other objects thereof becoming more apparent upon a reading of the following brief specification considered and interpreted in view of the accompanying drawings.

BRIEF DESCRIPTION OF THE PREFERRED EMBODIMENTS

Figure 1:
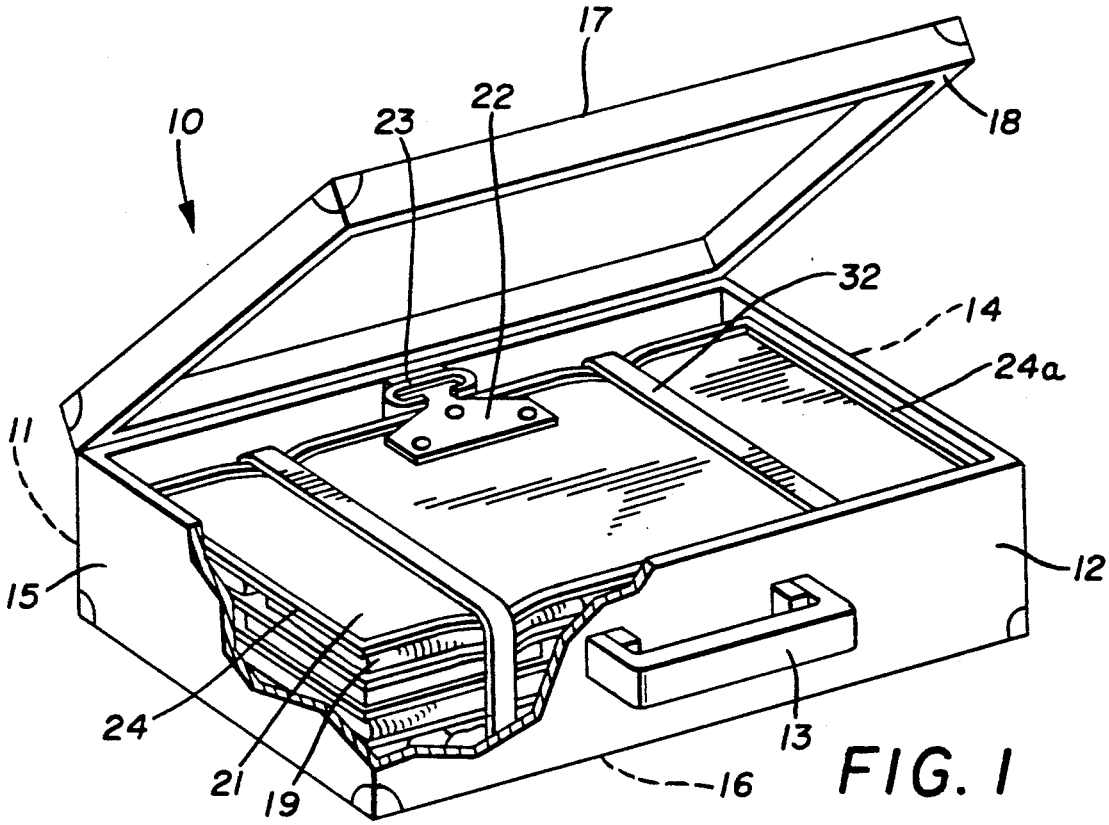
FIG. 1 is a perspective view, partially cut away, of a travel case having an organizer of the present invention.

A travel case having an organizer of the present invention is generally indicated by the numeral 10 in FIG. 1. Such a travel case is of the type generally known in the art and includes a bottom 11, a top 12 having a handle 13, two end walls 14 and 15, a back 16 and an opening front 17.

More particularly, bottom 11 and top 12 are separated by two opposing end walls 14 and 15. These components form a substantially rectangular frame. Back 16 is substantially rectangular in shape and of a size which enables its perimeter to attach at all points to one open side of the rectangular frame. Front 17 is also substantially rectangular in shape and of a size such that its perimeter may engage all points of the rectangular frame on the other open side.

Moreover, front 17 is hingedly attached only to bottom 11 so as to permit front 17 to open. Any attachment mechanisms as are generally known in the art, such as hinges (not shown), may be used to attach front 17 to bottom 11.

Further, front 17 may have a rim 18 adjacent to its perimeter and extending inwardly with respect to travel case 10 such that rim 18 may engage the rectangular frame rather than front 17 itself engaging the frame.

Travel case 10 may be fabricated from any material and by any process as is generally known in the art and may be of any commonly utilized planar configuration. Travel case 10 may be any case known in the art from briefcases to steamer trunks including those of rigid construction as well as those of "soft" construction.

Figure 2:
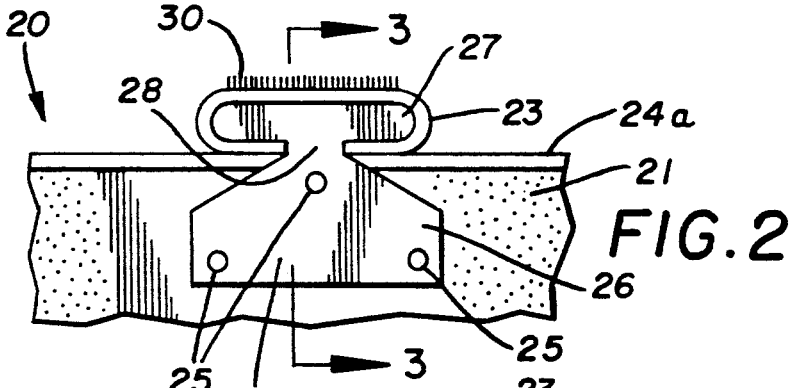
FIG. 2 is an elevational view of the relevant portion of a divider sheet having a lug attached to a track.
Figure 3:
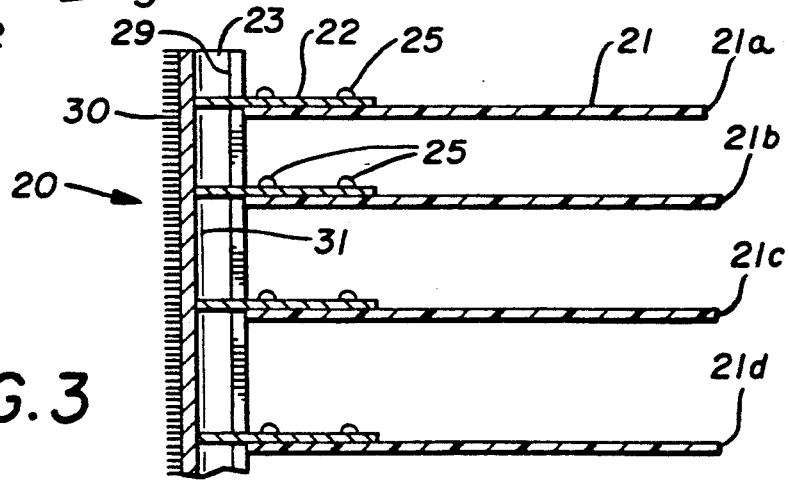
FIG. 3 is a sectional view taken along the line 3—3 of FIG. 2.

The significant aspects of the present invention can be seen in the organizer indicated generally by the numeral 20 in FIGS. 2 and 3. As will be detailed below, organizer 20 generally includes a divider sheet 21 attached to a lug 22 which engages a track 23 removably attached to travel case 10. Organizer 20 may include more than one divider sheet 21, each sheet 21 having one or more lugs 22 attached thereto. An equal number of tracks 23 as lugs 22 per divider sheet 21 should preferably be included, each track 23 being adapted to receive one lug 22 from each divider sheet 21.

Referring specifically to divider sheets 21, they are preferably low density polyethylene (LDPE) plastic sheets having a thickness of about 0.030 mm. LDPE is preferred because it is very flexible and follows the contours of articles 19 being separated. It, therefore, takes up substantially less space within travel case 10 than would most other materials.

In inexpensive luggage, divider sheets 21 may be roughened by an abrasive material to eliminate the possible movement of clothing or other articles therebetween as shown in FIG. 2. In more expensive luggage, divider sheets 21 may be covered by a material commensurate with the cost of the luggage. Such a material may be separately applied to each divider sheet 21 to match or contrast with the color of travel case 10. The material used may be anything from self-adhesive paper, such as commercially known Contact® paper, to, in the more expensive models, the same material as used in the manufacture of travel case 10 itself.

Divider sheets 21 are generally the same shape as the interior configuration of the case being used. In the form of the invention illustrated, divider sheets 21 are substantially rectangular in shape and of a size suitable to fit neatly within travel case 10. However, there should be enough space between the edges 24 of divider sheets 21 and end walls 14 and 15 to permit the user to grasp edges 24 of divider sheets 21 to lift them out of travel case 10 as will be described.

A reinforcing strip 24*a* of the same material as divider sheets 21 may be employed around the perimeter of sheets 21 to provide added strength to sheets 21 when lifting them out of travel case 10. Preferably, a one-inch wide band of the same plastic material is glued around the perimeter of each divider sheet 21. However, it should be noted that reinforcing strip 24*a* is generally as flexible as the rest of divider sheet 21 such that the entire sheet follows the contours of the articles being separated therebetween.

Lugs 22 may be attached to divider sheets 21 in any manner known in the art and, for purposes of this example, are attached by a plurality of rivets 25. The rivets 25 are positioned within the body 26 of lug 22, the body 26 generally overlapping divider sheet 21. Body 26 of lug 22 may be of any shape and large enough to secure adequately lug 22 to divider sheet 21. Nevertheless, body 26 should be small enough so as not to impair the flexibility of divider sheets 21 as explained above.

The other main component of lug 22 is the head 27 which engages track 23. The size and shape of head 27 is necessarily determined by the size and shape of track 23. The perimeter of head 27 is configured to fit neatly within track 23 so as to permit its translational movement within track 23. Lug 22 also has a neck 28 which connects the head 27 and body 26 portions together. Neck 28 is the narrowest part of lug 22 and has a length determined by the thickness of track 23.

Organizer 20 may have lugs 22 of any material adaptable to engaging track 23. It is preferred that plexiglass or lucite a thermoplastic polymer material, such as Plexiglas®, or an acrylic polymer resin, such as Lucite®, be used to permit smooth operation of lugs 22 on track 23. However, aluminum is also quite adequate for the engaging mechanism.

With respect to track 23, any material known in the art may be used to make track 23. Preferably, it is also made out of rigid, molded thermoplastic polymer material, such as Plexiglas®, acrylic polymer resin, such as Lucite®, or aluminum so as to provide support for divider sheets 21 and lugs 22 and for the smooth operation of lugs 22 within track 23. Track 23 should be generally configured to take up as little space as possible within the travel case 10 while still providing adequate support for the rest of organizer 20.

A configuration of the type preferred is depicted in FIG. 2. Such a track 23 is C-shaped so as to encase head 27 of lug 22. Further, track 23 is relatively flat so that more space for clothing and other articles may be made available within travel case 10. Further, it should be clear that head 27 of lug 22 is of the same general size and shape as the interior surface 29 of track 23.

Track 23 is, further, removably attached to travel case 10. This may be done in any manner as is known in the art. In the preferred embodiment, a hook and eye fabric 30, such as commercially known Velcro®, is attached to the back 31 of track 23 and also to the appropriate place in the bottom 11 of travel case 10. Thus, organizer 20 may be removed from travel case 10 simply by detaching track 23 from travel case 10.

Organizer 20 or travel case 10 may further include straps 32 to hold a plurality of divider sheets 21 together. Straps 32 may be independent of travel case 10 such that upon removal from holding divider sheets 21 and articles 19, they are separate items. Or, in a related embodiment, straps 32 may be attached to back 16 of travel case 10 whereupon removal of divider sheets 21 and articles 19 from said straps 32, straps 32 are still attached to travel case 10.

As should now be apparent, organizer 20 will permit the user to keep any articles 19 within travel case 10 neat and protected. An article of clothing or the like may be obtained from travel case 10 simply by lifting the necessary layers out of travel case 10 by sliding lugs 22 out of track 23, removing the article desired and replacing the layers back into travel case 10 by reengaging and sliding lugs 22 back down track 23.

For example, suppose an article of clothing is needed which is on the fourth layer down, i.e., between the third and fourth divider sheets 21*c* and 21*d*, respectively in FIG. 3. The user merely needs to grasp edges 24 of divider sheet 21*a* first and lift it out of travel case 10, holding the layer taut so as not to disarrange the articles thereon. Next, the user would repeat the operation with divider sheets 21*b* and 21*c*. Upon reaching the fourth layer, the user may remove the article of clothing desired. At this point, the user may wish to rearrange the clothing to take up any space left from the removal of the article. The layers are then returned, one at a time or together, to their original positions by reengaging lugs 22 with track 23.

The invention thus provides an organizer which permits clothing to be stored in a travel case in usable condition, thus essentially avoiding the need to unpack frequently. The nature of the divider sheets, and particularly their flexibility, insures efficient utilization of the available space, and the free riding engagement of the lugs with the track permits automatic accommodation of layers of varying thickness.

While a full and complete description of the invention has been set forth in accordance with the dictates of the Patent Statutes, it should be understood that modifications can be resorted to without departing from the spirit hereof or the scope of the appended claims.

Thus, it is again noted that the travel case illustrated in the drawings represents only a certain type of travel case and that any carrying case with an opening front may be applicable to the inventive concept disclosed and claimed.

Furthermore, any of the components of the organizer as described herein may be of any size or shape in accordance with the general description given hereinabove.

Also, while some particular materials have been mentioned by way of illustration, it will be apparent that the invention is not intended to be so limited and other materials having the characteristics described herein may be substituted therefor.

What is claimed is:

1. A travel case having a top, a bottom, two end walls, a back and an opening front, comprising:

a) C-shaped track means attached to the bottom of the travel case;

b) at least one flat dividing means for separating articles, the perimeter of each dividing means configured to fit neatly into the travel case;

c) lug means attached to each dividing means, each lug means releasably engaging said track means; and d) said dividing means being roughened by an abrasive material to eliminate the possible movement of articles positioned therebetween.

2. A travel case having a top, a bottom, two end walls, a back and an opening front, comprising:

a) C-shaped track means attached to the bottom of the travel case;

b) at least one flat dividing means for separating articles, the perimeter of each dividing means configured to fit neatly into the travel case;

c) lug means attached to each dividing means, each lug means releasably engaging said track means;

d) said dividing means including at least one low density polyethylene plastic sheet, any plurality of said plastic sheets being substantially parallel to each other when said lug means are in engagement with said track means; and e) strap means to hold a plurality of said plastic sheets together.

3. An organizer for a travel case comprising:

a) at least one flat dividing means for separating articles within the travel case and each said dividing means having opposed planar surfaces and a perimeter;

b) lug means attached to each said dividing means;

c) C-shaped track means releasably engaging said lug means, said track means being attached to the travel case;

d) said perimeter of said dividing means being configured to fit neatly within the travel case; and e) at least one planar surface of said dividing means being roughened to eliminate the possible movement of articles positioned therebetween.

4. A travel case having a top, a bottom, two end walls, a back and an opening front, comprising:

a) C-shaped track means attached to the bottom of the travel case;

b) at least one flat dividing means for separating articles, the perimeter of each dividing means configured to fit neatly into the travel case;

c) lug means attached to each dividing means, each lug means releasably engaging said track means;

d) said dividing means including at least one low density polyethylene plastic sheet, any plurality of said plastic sheets being substantially parallel to each other when said lug means are in engagement with said track means; and e) said lug means including a lug attached to each plastic sheet and made from the same material as said track means.

5. An organizer for a travel case comprising:

a) at least one flat dividing means for separating articles within the travel case and each said dividing means having a perimeter;

b) lug means attached to each said dividing means;

c) C-shaped track means releasably engaging said lug means, said track means being attached to the travel case;

d) said perimeter of said dividing means being configured to fit neatly within the travel case;

e) said dividing means including at least one low density polyethylene plastic sheet, any plurality of plastic sheets being substantially parallel to each other when said lug means are in engagement with said track means; and f) lug means including a lug attached to each plastic sheet and made from the same material as said track means.

* * * * *

UNITED STATES PATENT AND TRADEMARK OFFICE

CERTIFICATE OF CORRECTION

PATENT NO. : 5,150,776

DATED : September 29, 1992

INVENTOR(S) : Frances S. Rebenack

It is certified that error appears in the above-identified patent and that said Letters Patent is hereby corrected as shown below:

In Column 4, lines 20 and 21, delete the words "plexiglass or lucite".

Signed and Sealed this

Fourteenth Day of September, 1993

*Attest:*

Bruce Lehman

BRUCE LEHMAN

*Attesting Officer*

*Commissioner of Patents and Trademarks*